United States Patent [19]

Nakanishi

[11] Patent Number: 4,740,096

[45] Date of Patent: Apr. 26, 1988

[54] ELECTRONIC APPARATUS EQUIPPED WITH POWER-SAVING PRINTER

[75] Inventor: Yasuhiro Nakanishi, Nara, Japan

[73] Assignee: Sharp Kabushiki Kaisha, Osaka, Japan

[21] Appl. No.: 930,081

[22] Filed: Nov. 13, 1986

Related U.S. Application Data

[63] Continuation of Ser. No. 814,161, Dec. 23, 1985, abandoned, which is a continuation of Ser. No. 572,624, Jan. 24, 1984, abandoned, which is a continuation of Ser. No. 377,824, May 13, 1982, abandoned.

[30] Foreign Application Priority Data

May 18, 1981 [JP] Japan ..... 56-75363

[51] Int. Cl.[4] ..... B41J 29/58

[52] U.S. Cl. ..... 400/663; 400/669

[58] Field of Search ..... 400/8, 54, 663, 669; 235/58 P, 60 P, 61 PH; 364/705, 706, 707

[56] References Cited

U.S. PATENT DOCUMENTS

| | | | |
|---|---|---|---|
| 3,870,138 | 3/1975 | Sato et al. | 400/54 |
| 3,871,505 | 3/1975 | Theilen | 400/8 |
| 3,957,148 | 5/1976 | Milliser et al. | 400/54 X |
| 4,051,945 | 10/1977 | Fujimoto et al. | 197/176 |
| 4,074,284 | 2/1978 | Dexter et al. | 101/366 X |
| 4,279,523 | 7/1981 | Ringle | 400/54 X |

OTHER PUBLICATIONS

Sears Roebuck catalog, Fall/Winter 1978, pp. 1092–1093.

"Amplifier and Memory Devices: With Films and Diodes", McGraw-Hill, New York, 1965, edited by Prywes, pp. 53–58.

*Primary Examiner*—Charles A. Pearson

*Attorney, Agent, or Firm*—Birch, Stewart, Kolasch & Birch

[57] ABSTRACT

A printer-utilizing apparatus is disclosed herein, which decides automatically upon power throw whether the apparatus is in print mode or non-print mode and effects initializing of the printer and auto paper feed if the apparatus is in print mode, but does not conduct any printer operation such as initializing and paper feed, if the apparatus is in non-print mode. More particularly, the apparatus prevents unnecessary DC power consumption which otherwise would occur in a compact DC-powered printer apparatus and, when in print mode, conducts printer operations such as initializing of the printer and paper feed as well as notifying easily and clearly the operator that the apparatus has been turned on.

2 Claims, 1 Drawing Sheet

| (a) | (b) MODE | | (c) POWER | |
|---|---|---|---|---|
| ↑ | $\overline{P}$ | P | OFF | ON |
| 7 | 8 | 9 | ÷ | C |
| 4 | 5 | 6 | X | CE |
| 1 | 2 | 3 | − | % |
| 0 | • | +/− | + | = |

ELECTRONIC APPARATUS EQUIPPED WITH POWER-SAVING PRINTER

This application is a continuation of application Ser. No. 814,161, filed on Dec. 23, 1985, which is a continuation of Ser. No. 572,624, filed 1/24/84, which is a continuation of Ser. No. 377,824, filed 5/13/82, all abandoned.

BACKGROUND OF THE INVENTION

This invention relates to an electronic apparatus utilizing a printer, for example, a display/print type electronic calculator, and more particularly it relates to an electronic apparatus capable of automatically recognizing print mode.

In the conventional design of an electronic apparatus utilizing a printer such as a printing calculator, paper feed is usually effected for one or two lines concurrent with power throw for (1) notifying the operator of such power throw, (2) initializing the operational condition of the printer, and (3) providing a blank or space which distinguishes a new printing operation from the previous one.

In the case of another type of conventional apparatus with a DC-driven printer which does not require the step for initializing the operational condition of the apparatus from a structural point of view, the printer is prevented from operating when power is thrown, thus minimizing power consumption occurring in a DC power source. However, provided that initializing the operational condition of the printer and effecting one or two lines of paper feed occurs whenever power is thrown, power consumption in the power source is accelerated remarkably especially for a compact DC-powered printer apparatus. Furthermore, since the printer in the latter type does not work regardless of whether it stands in print mode or non-print mode, the operator shall make sure by a mode selector whether the printer is ready to work upon depression of a particular function key. This causes inconvenience and complicity of operation to the operator.

OBJECT AND SUMMARY OF THE INVENTION

Accordingly, it is an object of the present invention to provide an electronic apparatus equipped with a printer which overcomes the above discussed problem with the conventional devices.

It is another object of the present invention to provide an apparatus which decides automatically upon power throw whether the apparatus is in a print mode or a non-print mode and enables the initialization of a printer and an automatic paper feed, if the apparatus is in print mode, and does not conduct any printer operations such as initialization and paper feed, if the apparatus is in the non-print mode.

In other words, the printer-utilizing apparatus embodying the present invention, when in non-print mode, prevents unnecessary DC power consumption which otherwise would occur in a compact DC-powered printer apparatus immediately upon power throw and, when in the print mode, conducts printer operations such as initializing of the printer and automatic paper feed as well as notifying the operator easily and clearly that the apparatus has been turned on. Outstanding problems with the compact type printer apparatus include a limited capacity of the DC power source and a limited amount of consumables such as print paper.

However, should the apparatus be capable of deciding whether it is in the print mode or the non-print mode through deciding whether the printer is operating or not as taught by the present invention, it is possible to avoid unnecessary use of limited consumables due to wrong recognition of the operational condition of a mode selector.

In a preferred aspect of the present invention, there is provided an apparatus comprising a printer, decision means for deciding upon power throw whether the apparatus is in a print mode or in a non-print mode, and control means for allowing printer operations such as initializing and paper feed when in the print mode and preventing the printer operations from operating when in the non-print mode.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figures 1, 2:
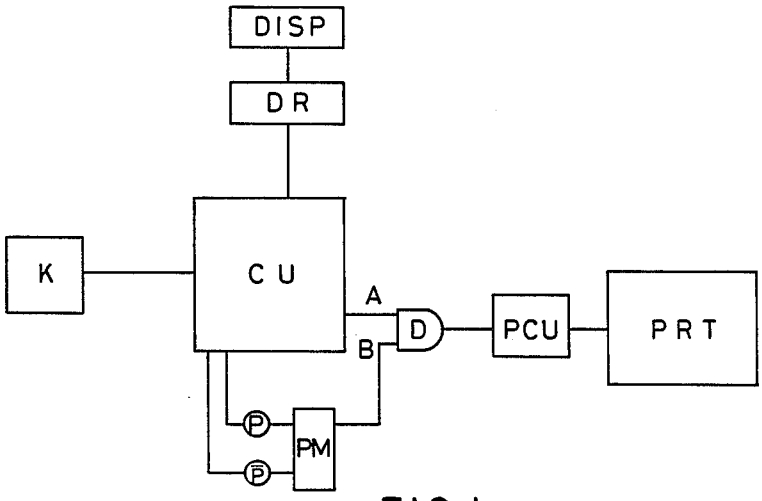
FIG. 1 is a circuit block diagram of a printer-utilizing apparatus according to an embodiment of the present invention.
FIG. 2 is an illustration of a key layout in connection with a key input circuit of the printer-utilizing apparatus.

Referring to the accompanying drawings, there is illustrated a printer-utilizing apparatus constructed according to an embodiment of the present invention. FIG. 1 is a circuit block diagram of the illustrated embodiment, which includes a key input circuit K, a sequential controller CU, a display driver DR, a display panel DISP, a flip-flop PM for storing a selected one of two operational modes, i.e. a print mode and a non-print mode, an AND gate D, a printer controller PCU and a printer PRT. There are shown micro-instructions P and $\overline{P}$. An input introduced via the key input circuit K is processed through the sequential controller CU and the result of such processing is visually displayed on the display panel DISP via the display driver DR. The apparatus in the illustrated embodiment serves as a so-called four-rule display type calculator.

FIG. 2 shows a key layout in connection with the key input circuit K of FIG. 1. In this drawing, there is the same layout as that of the so-called four-rule (including percent calculation) display type calculator except for three keys as denoted by (a) to (c) in FIG. 2. The first key (a) is to initiate paper feed in the printer PRT, that is, a paper feed key. The second key (b) is a non-print mode select key and, when depressed, permits the apparatus to serve as the above mentioned display type calculator because the printer PRT does not work even upon actuation of a particular function key when the non-print mode select key has been actuated. The last key (c) is a print mode select key by which the apparatus is permitted to serve as a displaying and printing type calculator. In other words, the apparatus displays the history and results of arithmetic operations upon actuation of one or more function keys on the display panel DISP and at the same time prints the same on the printer PRT via the printer controller PCU.

In FIG. 2, the "OFF" key is one which places all of the circuits except the flip-flop PM in FIG. 1 into an off state, whereas the "ON" key is one which places all of the circuits from an off state to an on state and permits arithmetic operations to be executed upon actuation of keys in the key input circuit K. The flip-flop PM is one which stores the selected one of the two operational modes, print mode and non-print mode, while being backed up with a battery regardless of actuation of the "ON" or "OFF" key. Upon actuation of the "P" key an electric signal indicative of such actuation is fed from the key input circuit K to the sequential controller CU so that the micro-instruction P from the CU becomes operative to set the flip-flop PM. On the other hand, when the "$\overline{P}$" key is depressed, the micro-instruction $\overline{P}$ from the sequential controller CU becomes operative to place the flip-flop PM into a reset state.

Assume now that the flip-flop PM is in the reset state and the apparatus therefore stands in a non-print mode. The circuit of FIG. 1 operates in the following manner when the "ON" key is actuated under the described circumstances. In response to the "ON" key being actuated, the circuit of FIG. 1 is rendered on. With the flip-flop PM in reset state, an input B to the AND gate D is always at a low level "L." The AND gate D is therefore kept in the off state regardless of any signal it receives at its other input A. This leads to the printer controller PCU and the printer PRT being idle when this occurs. To sum up, the printer does not perform either initialization or paper feed even when power is thrown as long as the apparatus is in the non-print mode.

The circuit of FIG. 1 will operate as follows when the "ON" key is depressed while the flip-flop PM is in set state. The circuit of FIG. 1 becomes operative upon depression of the "ON" key. At the same time the input B to the AND gate is constantly maintained at a high level "H" because of the flip-flop PM being in the set state and the other input A thereto receives an enabling signal from the sequential controller CU for the printer PRT. A signal applied to the input A is delivered from the output of the AND gate and is then fed to the printer controller PCU. In the case of a printer which needs initializing, the initializing and then paper feed are effected on the printer PRT.

As stated above, when power is thrown under the print mode of the appartus, initializing (if the printer needs to be initialized) and paper feed are effected.

As stated hereinbefore, the printer-utilizing apparatus embodying the present invention decides automatically upon power throw whether the apparatus is in a print mode or a non-print mode and effects initializing of the printer and auto paper feed if the apparatus is in print mode, but does not conduct any printer operations such as initializing and paper feed, if the apparatus is in a non-print mode.

More particularly, the apparatus prevents unnecessary DC power consumption which otherwise would occur in the compact DC-powered printer apparatus and, when in the print mode, conducts printer operations such as initializing of the printer and paper feed as well as notifying the operator easily and clearly that the apparatus has been turned on. In addition, the apparatus be capable of deciding whether it is in the print mode or the non-print mode through deciding whether the printer is operating or not as taught by the invention. It is possible to avoid unnecessary use of consumables due to wrong recognition of the operational condition of a mode selector.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A printer-utilizing apparatus comprising:

a printer;

a paper feed device for performing an automatic paper feed operation in said printer;

power means for energizing said apparatus, said power means including a power throw switch to control such energization;

means for selecting a print mode in said apparatus, said print mode enabling both initialization of said printer and said automatic paper feed operation;

means for selecting a non-print mode in said apparatus, said non-print mode preventing both initialization of said printer and said automatic paper feed operation;

memory means for storing signals indicative of whether said apparatus is in a print mode or a non-print mode when said power throw switch is turned off, said memory means being independent of said power means;

decision means, responsive to said signals, for deciding whether said apparatus is in the print mode or the non-print mode when said power throw switch is turned on thereby energizing said apparatus; and control means, responsive to said decision means, for both initializing said printer and performing said automatic paper feed operation in the print mode and for preventing both initialization of said printer and said automatic paper feed operation in the non-print mode.

2. An apparatus as set forth in claim 1 wherein said memory means comprises a flip-flop for storing a selected one of two operational modes, namely, said print mode and said non-print mode.

* * * * *